US007090116B2

(12) United States Patent
Cutler et al.

(10) Patent No.: US 7,090,116 B2
(45) Date of Patent: Aug. 15, 2006

(54) MEDICINE CUP

(76) Inventors: Carol Sale Cutler, 126 Tranquila Dr., Camarillo, CA (US) 93012; David W. Cutler, P.O. Box 4466, Thousand Oaks, CA (US) 91359; Glenys Wilbur, 83 W. Crown St., Ojai, CA (US) 93023

( * ) Notice: Subject to any disclaimer, the term of this patent is extended or adjusted under 35 U.S.C. 154(b) by 426 days.

(21) Appl. No.: 10/729,036

(22) Filed: Dec. 5, 2003

(65) Prior Publication Data

US 2005/0121456 A1 Jun. 9, 2005

(51) Int. Cl.
*A47G 19/22* (2006.01)

(52) U.S. Cl. ..... 229/400; 220/669; 215/382

(58) Field of Classification Search ..... None
See application file for complete search history.

(56) References Cited

U.S. PATENT DOCUMENTS 4,185,764 A * 1/1980 Cote ..... 229/117.03
4,200,219 A * 4/1980 Ramich ..... 229/106
4,252,264 A * 2/1981 Herbst et al. ..... 229/400
6,561,414 B1 * 5/2003 Cai ..... 229/400

* cited by examiner

*Primary Examiner*—Stephen Castellano
(74) *Attorney, Agent, or Firm*—Michael G. Petit

(57) ABSTRACT

A cup for dispensing liquid and solid medication. The cup has a bottom 12, two sides 14, 16, extending upwardly from the bottom to form a rim 26 at a top of the cup, and a ramp 18 extending outwardly from the bottom 12 at least part way to the rim. The two sides and the ramp 19 join to form a mouthpiece of the cup. An upper vertical portion 24 extends downward from the rim 26. The ramp 19 extends outwardly from the bottom 12 to the upper vertical portion 24 such that the two sides 14, 16, the ramp 19, and the upper vertical portion 24 join to form a mouth piece of the cup. The cup allows an individual to consume the entire contents within the cup without moving the head or neck backwards.

1 Claim, 2 Drawing Sheets

MEDICINE CUP

BACKGROUND OF THE INVENTION

1. Field of the Invention

This invention relates a medicine-dispensing cup for liquid or solid medication that allows an individual to consume the entire contents within the cup without moving the head or neck backwards.

2. Description of the Prior Art

A number of patents are concerned with containers designed to ease ingestion of liquids or solids by an individual. Hucknall, in U.S. Pat. No. 2,599,919, shows a container fitted with an integral straw-like passage that extends above the container top. In U.S. Pat. No. 3,014,621, Povitz discloses a plastic lip and handle that attaches to a beverage can. Hostetter, in U.S. Pat. No. 3,134,523, shows a hospital cup with a foldable top edge that contains a small conduit to allow a prone individual to drink from the conduit. A drinking attachment for a can that includes an extended lip portion is described by Ward in U.S. Pat. No. 3,429,478. A closure device with a pouring lip for containers is disclosed by Kapples in U.S. Pat. No. 3,972,453. Watson, in U.S. Pat. No. 4,235,348, describes a drinking container with an open trough-like spout projecting laterally from one side. Junkman et al., U.S. Pat. No. 4,887,729, discloses a two-handled cup for handicapped persons. In U.S. Pat. No. 5,323,928, Stevens describes a dysphagia cup having sloping interior surfaces and an elliptically-shaped top opening to accommodate a user's nasal bridge during drinking such that substantial backwards angulation of the head is not required. Sang-Seo, in U.S. Pat. No. 5,415,313, shows a beverage can with a lip that protrudes from the top of the can upon removing a pull tab to open it. Neville U.S. Pat. No. 5,645,191 discloses a disposable safety cup with a spout formed by the container side and attached cup cover.

It is desirable to provide a dispensing cup for liquid or solid medication that allows an individual to consume the entire contents within the cup without moving the head or neck backwards.

SUMMARY OF THE INVENTION

Briefly, the invention is concerned with a dispensing cup for liquid and solid medication. The cup has a bottom, two sides, extending upwardly from the bottom to form a rim at a top of the cup, and a ramp extending outwardly from the bottom, part way or all the way to the rim. The two sides and the ramp join to form a mouthpiece of the cup.

An advantage of the invention is that it provides a dispensing cup for liquid or solid medication that allows an individual to consume the entire contents within the cup without moving the head or neck backwards.

The invention has the further advantage that liquid or solid contents that would otherwise settle at the bottom of the cup are dislodged when the cup is tilted.

The invention has the further advantage that the shape of the cup allows stacking of a number of cups for storage.

BRIEF DESCRIPTION OF THE DRAWINGS

The invention will be described in greater detail with reference to the drawings in which.

In these figures, similar numerals refer to similar elements in the drawing. It should be understood that the sizes of the different components in the figures may not be to scale, or in exact proportion, and are shown for visual clarity and for the purpose of explanation.

DETAILED DESCRIPTION OF THE INVENTION

The design of the cup is to benefit people that have restricted movement of the head and neck region. The design of the cup enables a person with these restrictions, to easily consume the entire contents within the cup without moving the head or neck backwards. The cup will be used in the medical field and the private sector. Typical users that will benefit from this design include, but are not limited to, the physically handicapped, bedridden patients, those with loss of muscle control and the elderly.

Figure 1:
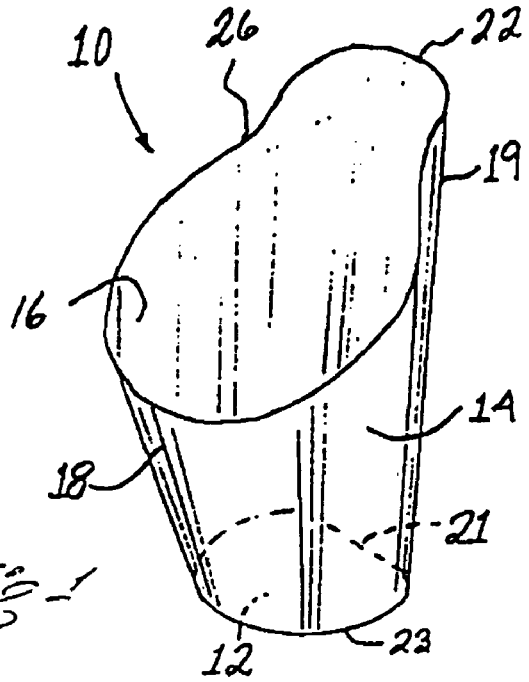
FIG. 1 is a top perspective view of a medical cup, in which the present invention is embodied.
Figure 2:
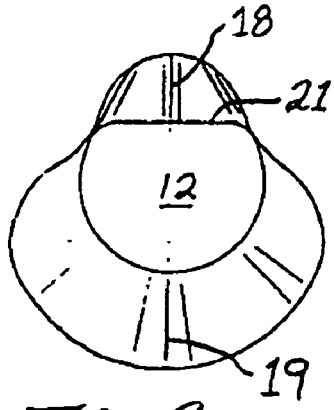
FIG. 2 is a bottom view of the cup shown in FIG. 1; and, FIG. 3 is a top view of the cup shown in FIG. 1.
Figure 3:
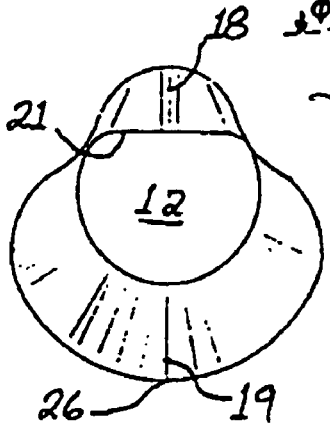
Figure 4:
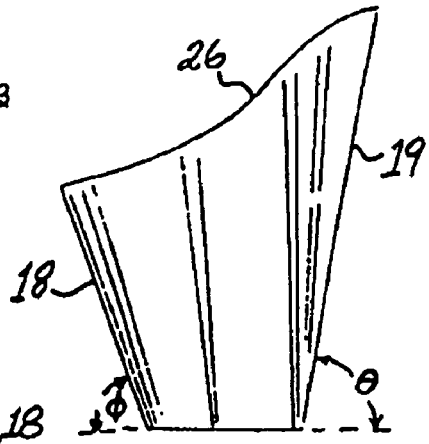
FIG. 4 is a side view of the cup shown in FIGS. 1—3.

Referring now to FIG. 1, a medical cup 10 is illustrated in upper perspective view. The medical 10 is exemplary of a medical cup in which the present invention is embodied. The bottom 12 has a curved edge 23 and a linear edge 21. A ramp-like mouthpiece portion 19 extends outwardly from the bottom 12 to a top rim 26. Two curved sides, 14, 16, extend from the bottom 12 to the top rim 26. The two curved sides join the ramp-like mouthpiece portion and meet at a short edge 18 with a linear and substantially vertical seam opposite the mouthpiece portion 19. The short edge 18 is shorter than the extended ramp-like mouthpiece portion 19. The short edge 18 extends outwardly from the bottom 12 at an angle $\theta$ from the bottom 12. The bottom 12 is also angled at an angle $\Phi$ from the short edge 18 to the ramp-like mouthpiece portion 19. The ramp-like mouthpiece portion has an upwardly and outwardly tapering curvilinear shape that extends from the linear edge 21 to an uppermost portion 22 of the top rim 26 to form the ramp-like mouthpiece portion 19. The medical cup 10 is shown in bottom, top and side views in FIGS. 2, 3 and 4 respectively.

Figure 5:
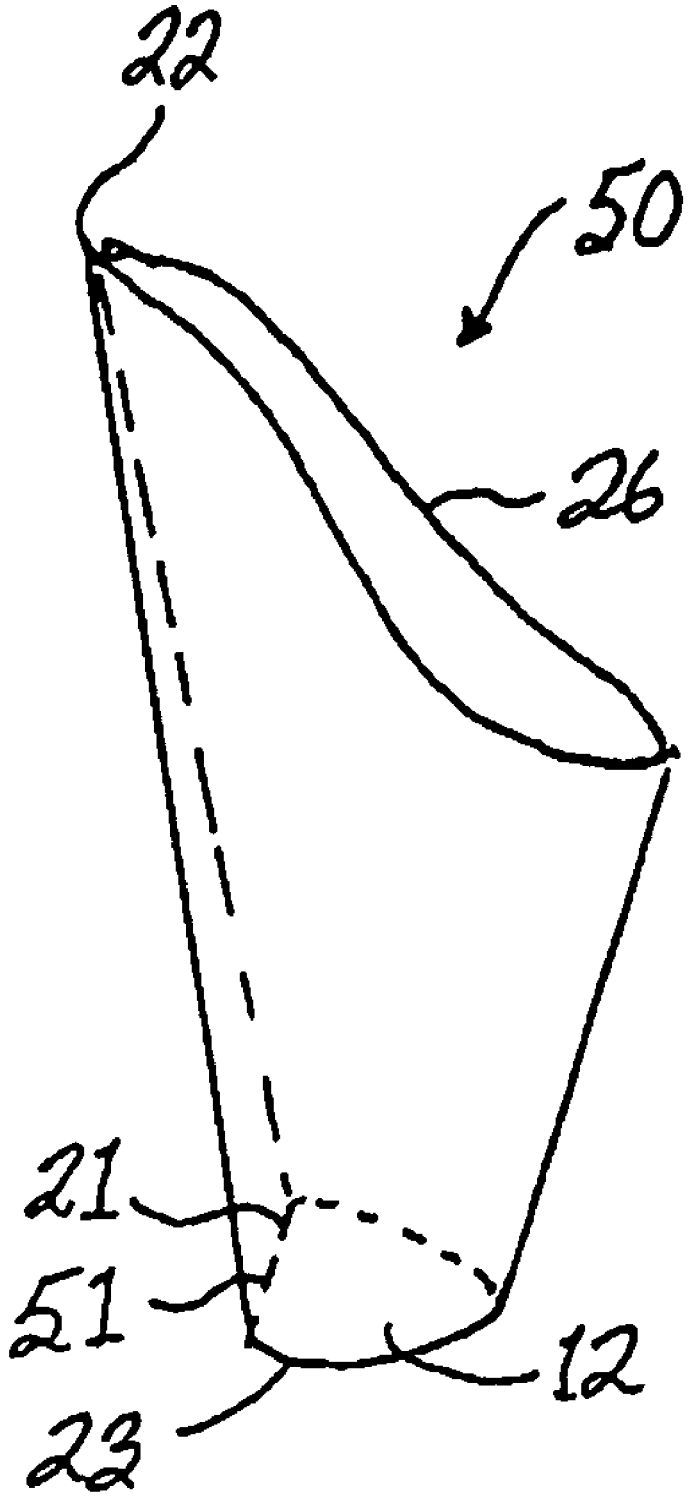
FIG. 5 is a top perspective view of an embodiment of a second preferred embodiment of a medical cup in accordance with the present invention wherein the ramp-like mouthpiece portion has a triangular shape.

The ramp-like mouthpiece portion 19 may also have a polygon shape rather than a curvilinear shape. An example of an embodiment of the medical cup of present invention wherein the ramp-like mouthpiece portion is an isosceles triangle is shown in perspective view at numeral 50 in FIG. 5. In medical cup 50, the uppermost portion 22 of the rim 26 is the vertex of an isosceles triangle wherein the base of the triangle 51 is congruent with the linear edge 21 of the bottom 12. Furthermore, the curved edge 23 of the bottom of the cup may be partially circular in shape or partially elliptical in shape. The rim 26 of medical cups 10 and 50 preferably have a greatest height of about 2.5 inches, a least height of about 2.5 inches and a bottom having a greatest diameter of about 1.2 inches. The total volume of the cup is preferably approximately 1 oz.

When the cup is tilted toward the user, the extended mouthpiece allows the contents to enter the mouth without the users nose hitting the rim of the cup. Simultaneously, the displacement angle of the ramp displaces the contents that would normally settle at the bottom of the cup. Because creating a displacement angle $\theta$ requires the loss of material on the bottom of the cup, the cup would normally become unstable and could fall over and spill. In order to counteract the tendency of the inclined ramp-like mouthpiece portion

19 to shift the center of gravity of the cup causing instability and to stabilize the cup, the bottom 12 is inclined by an angle Φ from the shorter side 18 to counterbalance the longer mouthpiece side 19. This compensates for this potential loss of stability, since the counterbalance angle Φ shifts the center of gravity of the cup. The plane caused by the creation of this counterbalance angle Φ, runs from the shorter edge 18 of the cup and meets the plane of the displacement angle at the bottom of the cup. This design allows the cup contents to enter the mouth of an individual without the nose of the user contacting the rim of the cup.

SUMMARY

A dispensing cup for liquid and solid medication is disclosed. The cup comprises a bottom 12 two sides 14, 16, extending upwardly from the bottom to form a rim 26 at a top of the cup and, a ramp 19 extending outwardly from a linear edge 21 of the bottom part way or all the way to the rim, the two sides and the ramp 19 joining at 22 to form a mouthpiece of the cup. The cup may be constructed of any suitable material, such as paper, Styrofoam, or a plastic material. If a plastic such as polyethylene is used, the cup may be formed through an injection molding process. Identical cups will fit within each other to save space in packaging and delivery and in storage or in cup dispensers. The cup may have graduated markings as a guide for measuring the volume of the contents.

It should be understood that various modifications could be made to the shape of the cup without departing from the scope of the invention. For example, the ramp may extend only part way to the rim of the cup. Furthermore the ramp may not form a triangle. For example, the vertex 22 may be changed to form a fourth side of a polygon, with the shorter side of the polygon being the vertex, resulting in a wider mouthpiece, the ramp 19 extending all the way or part way to the rim 26. The bottom of the cup has been shown as a somewhat elliptical shape. The bottom may be modified to be more circular in shape at the curved edge opposite the linear edge 21 at the base of the ramp 19. This would cause the sides 14, 16 to become more circular in shape.

While the invention has been particularly shown and described with reference to preferred embodiments thereof, it will be understood by those skilled in the art that the foregoing and other changes in form and detail may be made therein without departing from the scope of the invention.

We claim:

1. A medical cup for dispensing liquids and solids comprising:

an entirely flat bottom 12 having a curved edge 23 and a linear edge 21;

a top rim 26;

a ramp-like mouthpiece portion 19 having the shape of an isosceles triangle extending outwardly from said linear edge of said bottom 12 to a top rim 26 with the apex of the ramp-like mouthpiece disposed on said top rim and the base of the ramp-like mouthpiece coextensive with said linear edge of said bottom; and, two curved sides, 14, 16, extending upwardly from said curved edge 23 of said bottom 12 to said top rim 26, said two curved sides joining said ramp-like mouthpiece portion and meeting at a short edge 18 with a linear and substantially vertical seam opposite said ramp-like mouthpiece portion; said short edge 18 being shorter than said extended ramp-like mouthpiece portion, said short edge 18 extending from said bottom 12 outward at an angle Φ from said bottom 12; wherein said entirely flat bottom and said two curved sides form a leakproof fluid container.

* * * * *